US005803581A

United States Patent [19]

Brockmann

[11] Patent Number: 5,803,581

[45] Date of Patent: Sep. 8, 1998

[54] DEVICE TO ILLUMINATE KEYHOLE AREA

[76] Inventor: Eric E. Brockmann, 1237 Harmony Station Rd., Phillipsburg, N.J. 08865

[21] Appl. No.: 815,126

[22] Filed: Mar. 11, 1997

[51] Int. Cl.[6] ..... E05B 17/10

[52] U.S. Cl. ..... 362/100; 362/152; 362/251

[58] Field of Search ..... 362/100, 152, 362/234, 249, 251, 240

[56] References Cited

U.S. PATENT DOCUMENTS

| | | | |
|---|---|---|---|
| 500,026 | 6/1893 | Morey . | |
| 1,191,783 | 7/1916 | Harsh . | |
| 1,647,001 | 10/1927 | Hendrickson . | |
| 1,961,865 | 6/1934 | Remington . | |
| 2,007,101 | 7/1935 | Vonderembse . | |
| 2,179,662 | 10/1939 | Babb . | |
| 2,254,842 | 9/1941 | Gray . | |
| 2,562,687 | 7/1951 | Anderson | 362/100 |
| 2,813,195 | 11/1957 | Willey et al. . | |
| 2,927,197 | 3/1960 | Phillips et al. | 362/100 |
| 4,281,368 | 7/1981 | Humbert | 362/100 |
| 4,779,171 | 10/1988 | Ferguson | 362/100 |

*Primary Examiner*—Stephen F. Husar

*Attorney, Agent, or Firm*—Richard C. Litman

[57] ABSTRACT

A keyhole illuminating device incorporating a constantly-lit rocker switch to provide continuous illumination and high visibility, without a significant expenditure of energy. The device is easily installed in a door jamb, proximate to a keyhole. Upon accessing the illuminated rocker switch, a homeowner can actuate it to provide the additional illumination provided by an incandescent lamp, with which to better see the keyhole. A housing and circuit terminals contain the operational components of the device. An incandescent lamp provides means for illuminating the rocker switch on a continual basis. The incandescent lamp operably engages a control element, ultimately engaging an existing door bell transformer. As such transformers output low voltage, the current conveyed therefrom enables the incandescent lamp to illuminate the rocker switch on an ongoing basis, at a minimal power consumption. A second incandescent lamp provides further illumination for a homeowner accessing a keyhole. Actuating illuminated rocker switch enables completion of the circuit to illuminate the second incandescent lamp. The radiant energy generated by the incandescent lamp shines through a translucent screen in a cover plate to illuminate the area surrounding a keyhole.

9 Claims, 4 Drawing Sheets

DEVICE TO ILLUMINATE KEYHOLE AREA

BACKGROUND OF THE INVENTION

1. Field of the Invention

The present invention relates to illumination devices for keyhole areas, and more specifically, to switch-actuated light sources for permanent mounting in the proximity of doors having keyholes.

2. Description of the Prior Art

Safety and convenience concerns have led to the development of many types of illumination devices for use with doors having keyholes. Some of these devices propose battery-powered means for illuminating a keyhole, as in the inventions described in U.S. Pat. Nos. 1,647,001, 2,007,101, 2,813,195 and 4,281,368. Other devices for illuminating keyhole areas employ AC power sources, avoiding a situation wherein a weak or dead battery would render the device inoperative.

Operation of the inventions described in U.S. Pat. Nos. 500,026, 1,191,783 and 2,176,662 involve manually operating a button or a switch which ultimately completes an electrical circuit that actuates a keyhole illumination device. Unfortunately, for a user to locate the switch or button in the dark could prove as troublesome as accessing the keyhole itself in the dark.

U.S. Pat. No. 1,961,865 discloses a combination house illuminated identifier and key hole device that aims to solve this problem. A continuously illuminated house identifier is installed proximate to a door casing, or jamb, on the side opposing the keyhole, to project a continuous light beam thereon. Two lamps comprise means for illuminating the house-identifying indicia while shining a beam onto the keyhole from across the door. Even though the combination assembly employs low resistance components, the continued illumination of both lamps unnecessarily tasks the house lighting circuit that powers the device. Additionally, a person standing in front of the door would interrupt the projected light beam, thereby obscuring the keyhole in darkness.

Another device for keyhole illumination is described in U.S. Pat. No. 2,254,842. A main lamp housing is installed proximate to a door, illuminating a doorbell by projecting light through an annular aperture thereabout. A separate side projector member directs light away from the main lamp housing to illuminate a keyhole. The illumination device of '842 therefore necessitates the creation of both a rectangular opening and a round bore in the door jamb, to accommodate the main lamp body and the side projector member, respectively, ultimately making installation and relocation more difficult and more costly.

In light of the shortcomings of the above inventions and patents, there is a need for a keyhole-illuminating device that provides easy access and high visibility in the dark, while requiring minimal energy expenditure. There is also a need for a reliable device that provides unobscured keyhole illumination, and is easy to install and remove for relocation thereof, if desired.

None of the above inventions and patents, taken either singly or in combination, is seen to describe the instant invention as claimed.

SUMMARY OF THE INVENTION

The keyhole illuminating device of the present invention incorporates a constantly rear-lit rocker or toggle switch, providing continuous illumination and high visibility without a significant expenditure of energy, which switch activates a first light source directed onto a keyhole. The device is easily installed into a door jamb, proximate to a keyhole.

The preferred embodiment of the present invention comprises a substantially rectangular plate and a housing attached thereto. The plate defines two windows, a first for passage of light from a first lamp assembly and a second for framing of an illuminated rocker-type electrical switch, respectively. A translucent screen spans the window framing the lamp assembly, either as an integral part of the plate or as a cover to an opening. Screws engage apertures defined by the plate to secure the keyhole illumination device into a door jamb.

The housing contains the operational components of the device. Circuit terminals engage the lower rear part of the housing, the circuit terminals having a plurality of screws for attachment of supply wires from a low-voltage transformer. The terminals are operably connected by a circuit to the supply terminal of the rocker-type electrical switch, which switches power on and off to a first lamp for illumination of the keyhole. The radiant energy generated by the first lamp shines through the translucent screen to illuminate the area surrounding a keyhole. A second lamp, typically an incandescent filament, is provided internally to the rocker switch, to provide continual, rear illumination of the rocker switch. As such transformers output low-voltage and low-current, the second lamp can illuminate the rocker switch on an ongoing basis at a minimal power consumption, thereby allowing use of the first lamp only as necessary for illuminating the keyhole. An added advantage to such low-current device is that the risk of damaging shock to an individual is minimized.

Accordingly, it is a principal object of the invention to provide easy access and high visibility in the dark to a keyhole, while requiring minimal energy expenditure.

It is another object of the invention to provide a device which minimizes obstruction of keyhole illumination due to passage of a user through the light path.

It is a further object of the invention to allow easy installation and removal thereof.

Still another object of the invention is to incorporate a device having an illuminated switch for selectively enabling further illumination of the keyhole thereby minimizing power consumption.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
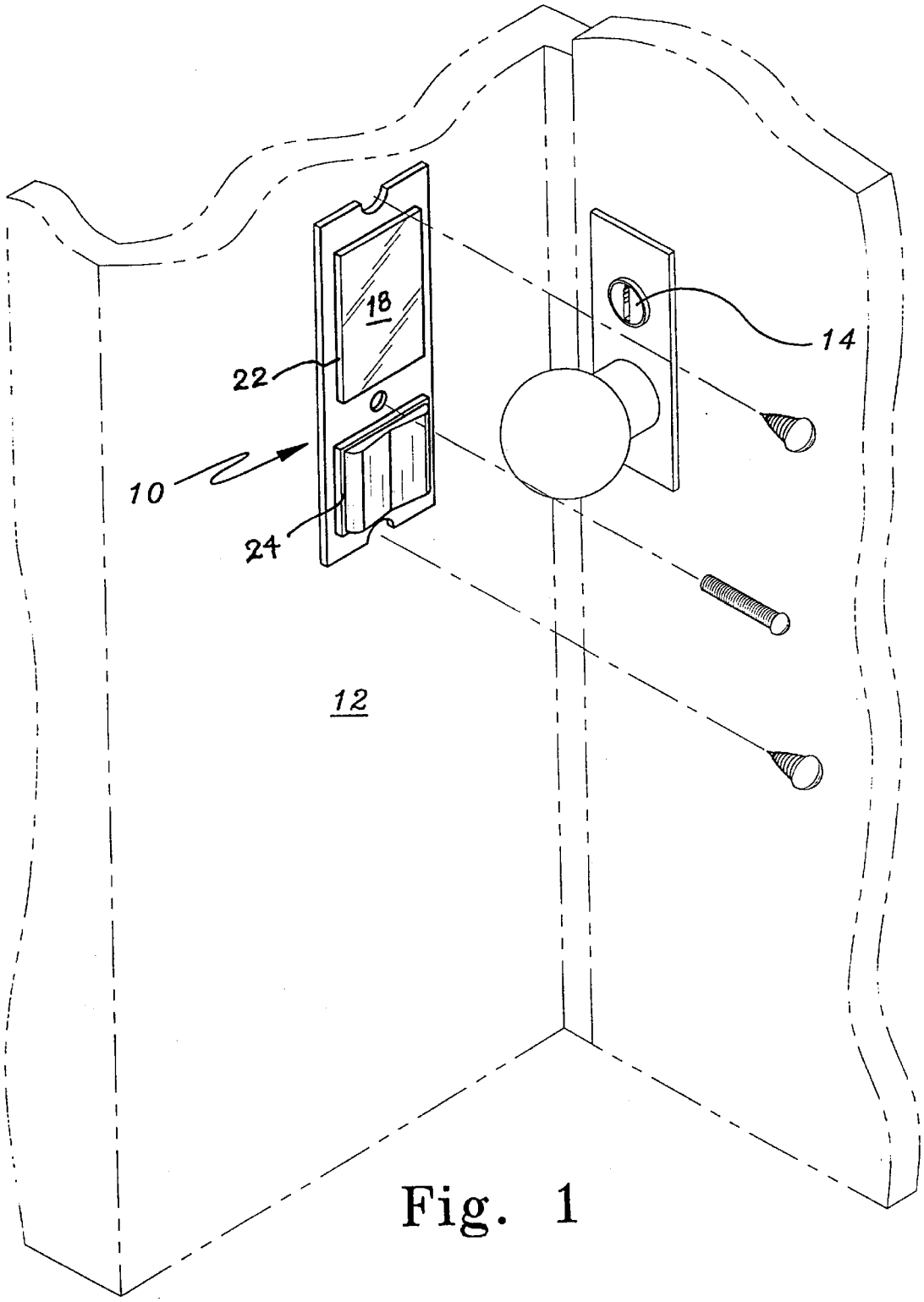
FIG. 1 is an environmental view of the keyhole illumination device of the present invention.
Figure 4:
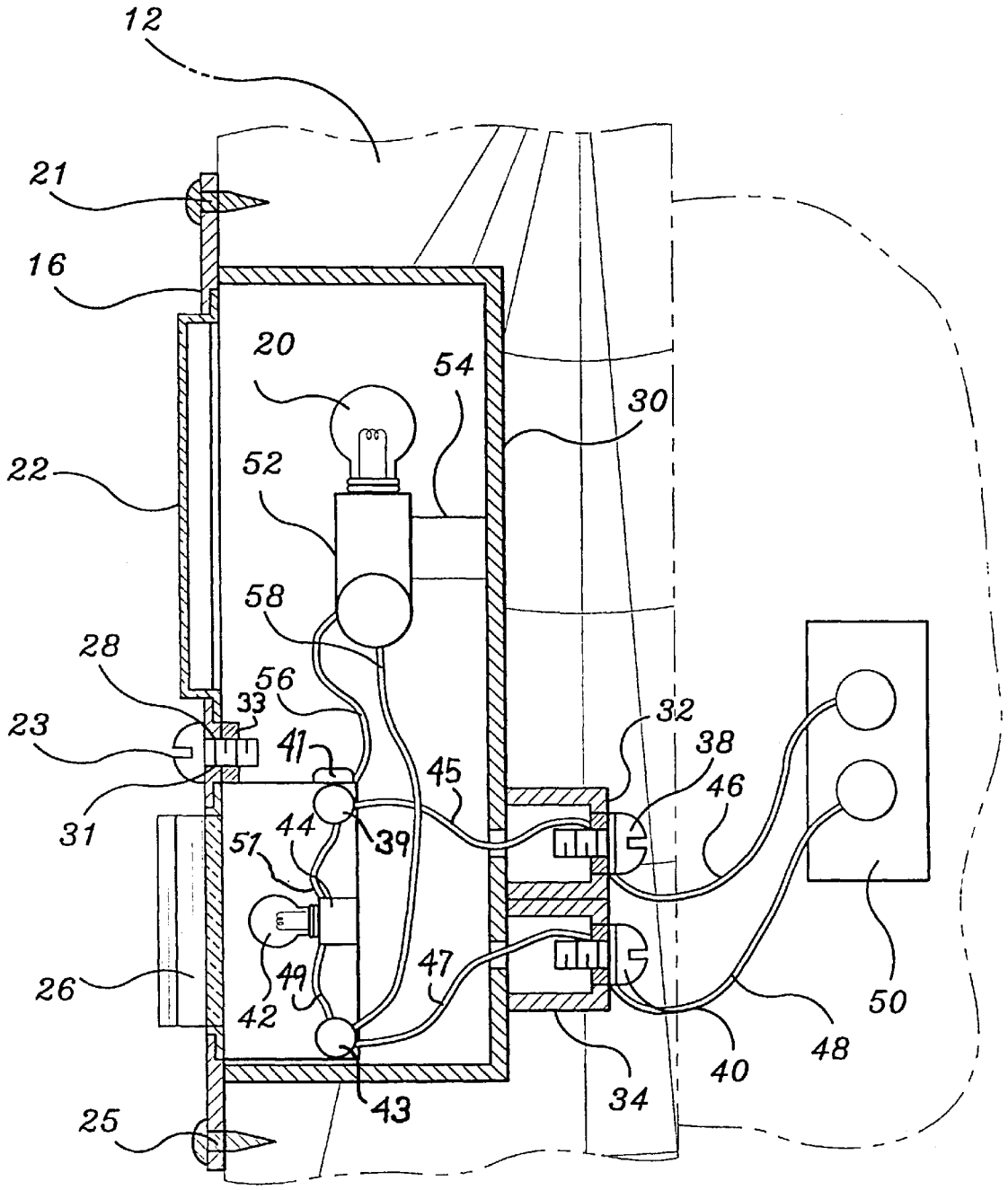
FIG. 4 is a partial cross-sectional view of the keyhole illumination device along the line 4—4 in FIG. 2.

As illustrated in FIG. 1, the preferred embodiment 10 of the present invention is generally shown installed in a door jamb 12 proximate to a keyhole 14. As best shown in FIG. 4, preferred embodiment comprises a housing 30, having a substantially rectangular cross-section defining a box with an open front, a plate 16 for covering the open front and defining a plurality of windows, and operable components housed within the housing 30 including a rocker-switch 26, having a continually-illuminated second lamp assembly 42, and a first lamp assembly 20 controlled by rocker switch 26 powered by a low-voltage power source 50.

Figure 2:
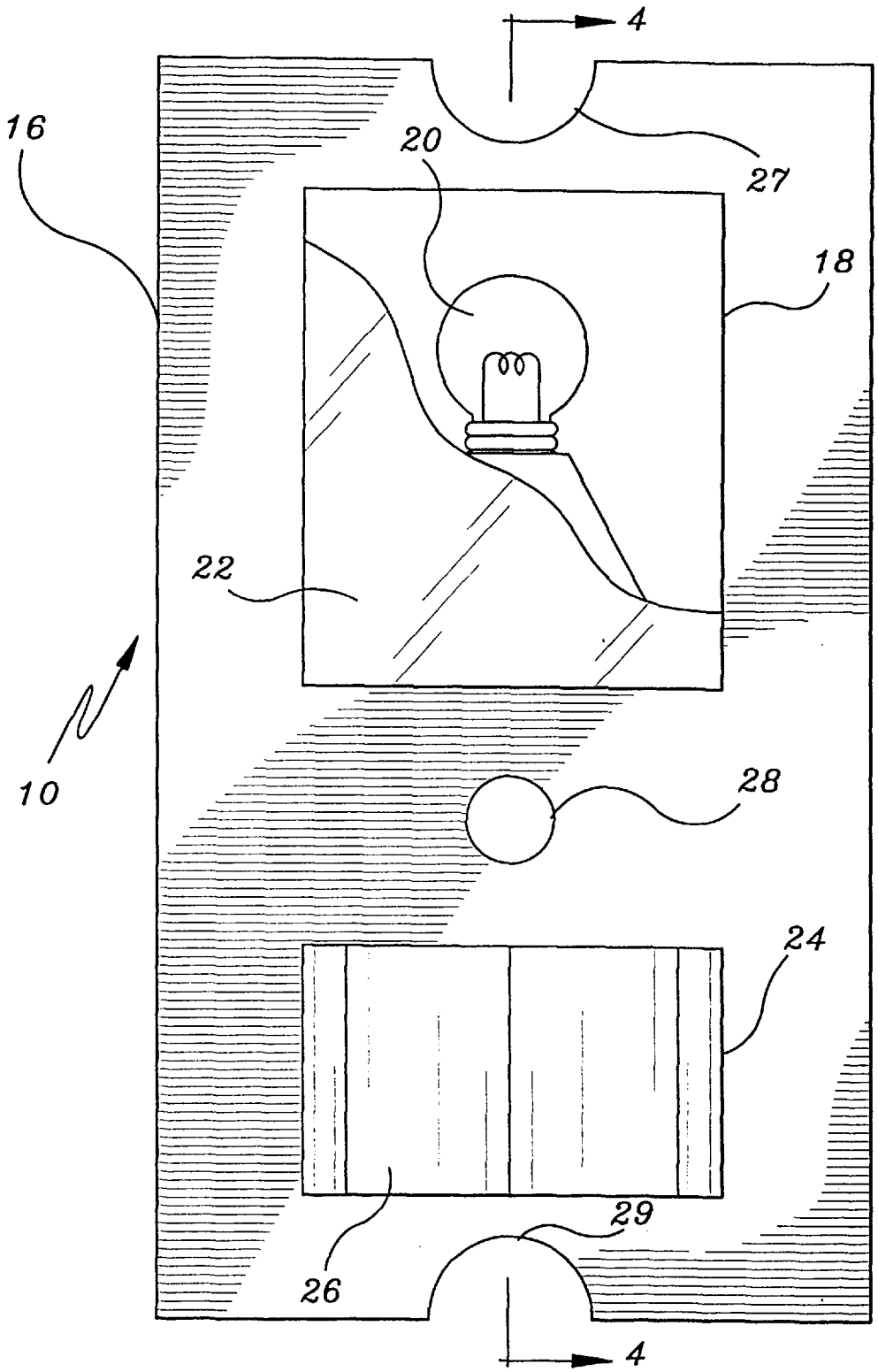
FIG. 2 is a front elevational view of the keyhole illumination device, partially fragmented to show a diagrammatic representation of its internal lamp for illuminating the keyhole.

As shown in greater detail in FIG. 2, a substantially rectangular plate 16 defines a substantially square, first window 18 positioned proximate to first lamp assembly 20. First window 18 provides a translucent window for passage of light from a first lamp assembly 20 for casting light upon the keyhole. In the embodiment shown in FIG. 1, a substantially square, translucent screen 22 covers and opening in plate 16 to form first window 18. A simple alternative embodiment can be envisioned in which the first window 18 is integrally formed with plate 16, providing a translucent pane area corresponding to window 18, similar to the diagrammatic representation of window 18 shown in FIG. 2. Such embodiment may consist of a plate 16 made of materials such as clear PLEXIGLAS in which the first window 18 is defined by an opaque application of paint or like material to frame the first lamp assembly 20.

In FIGS. 1 and 2, plate 16 also defines a substantially rectangular, second window 24, oriented with its longer sides parallel to the bottom side of first window 18. Second window 24 is an opening dimensioned and configured to closely accept and frame an illuminated toggle-type switch, which includes the stream-lined, rocker-type electrical switch 26 shown, the toggle and rocker switches being well-known in operation and structure. Most rear-lit illuminated rocker switches include a circuit which allows a second lamp 42 in the switch 26 to be continually lit for rear illumination; the switch further contains a mechanical switching mechanism (not shown) which controls operation of a first lamp 20 provided in the present invention for illuminating a keyhole.

However, in the present invention, a transformer or low-voltage power supply 50 supplies direct current to the switch 26, thus making automotive rocker switches the preferred type of switch, over standard household, alternating-current accepting switches. In such automotive switches, three leads are commonly provided, a supply lead 39 accepting the incoming current and passing it to a conventional mechanical switching mechanism (not shown), the lead 41 from the switch to the first lamp 20, and the neutral lead 43 returning to the transformer 50 and ground, and receiving the return wire from the first lamp 20. To insure that the rocker-switch 26 is continually illuminated, the circuit of most conventional automotive rocker switches may be modified to provide a like circuit as shown, in which the second lamp 42 is in continually illuminated condition.

As represented in the FIG. 4, second lamp 42, which provides rear illumination of rocker switch 26 on a continual basis, is diagrammatically represented as an incandescent bulb operably connected to a control element or socket 44. However, commonly used light filaments, light emitting diodes, fluorescent or other types of low-voltage, electrically powered lamps may be used, as suited to the present application. Conducting wires 51,49 extend from control element 44 to supply and ground lead 39,43, respectively, and in turn pass via conducting wires 45,47 to engage a plurality of electrically conductive terminals 32,34. The wires 45,47 are each respectively attached within a circuit terminal 32,34, wire 47 engaging a grounding terminal and wire 45 engaging a positive supply lead, through which current is conveyed from transformer 50 to control element 44 and to switch 26. Circuit terminals 32,34 are attached to the lower rear, external surface of housing 30 to provide convenient connect-disconnect access to the internal operational components within housing 30. Screws 38,40 secure conducting wires 48,46 to the circuit terminals 32,34. The conducting wires 46,48 lead to the power supply, a low-voltage transformer 50 of the existing door bell circuitry. Transformer 50 runs household current to produce a low-voltage, low-current output, typically between 6 and 20 volts. Incandescent second lamp 42 can therefore illuminate rocker switch 26 on an ongoing basis, at a minimal power usage, by using the current passed from transformer 50.

A replaceable, first lamp assembly 20 provides further illumination for a homeowner accessing a keyhole, and is diagrammatically represented as an incandescent bulb operably connected to a control element or socket 52. However, other commonly used electrically powered lamps may be used. Support member 54 secures a bayonet lamp holder 52 to the inside back surface of housing 30 and supports incandescent lamp 20. Conducting wires 56,58 extend from leads 41,43 to supply interruptable current to first lamp 20. Toggling illuminated rocker switch 26 enables completion or interruption of the circuit to incandescent lamp 20. The radiant energy generated by incandescent lamp 20 shines through translucent screen 22 to illuminate the area surrounding a keyhole.

Figure 3:
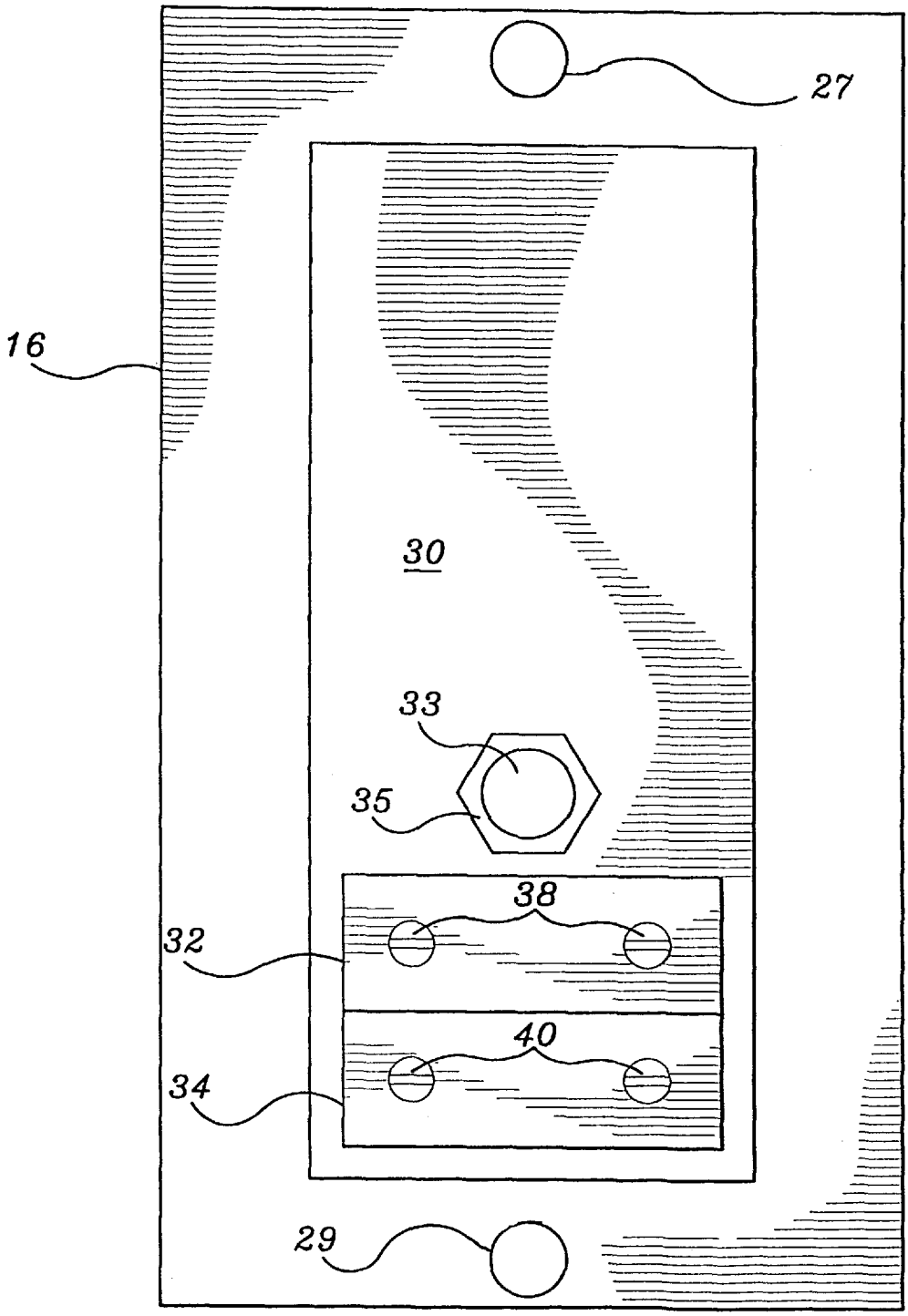
FIG. 3 is a rear elevational view of keyhole illumination device.

Turning now to a discussion of the features of the invention which enable its convenient installation in a door jamb near a keyhole, it can be observed from FIGS. 1, 2 and 3 that, in the preferred embodiment of the invention, the plate 16 is provided with apertures 27,29 at the top and bottom of the central vertical axis of thereof. Although semi-circular cutouts are shown in FIG. 1 and 2, through bores may be included in the plate 16 instead as shown in FIG. 3. These apertures 27,29 accept fasteners 21,25, such as screws, nails or bolts, to secure the keyhole illumination device 10 into door jamb 12.

After attaching the proper conducting wires from the transformer to the circuit terminals, the housing 30 is inserted into an opening created in the wall or door jamb properly positioned proximate a keyhole. The plate 16 supports housing 30 by a screw or bolt 23 which passes through aperture 28 in the substantial center of plate 16 and mates with a corresponding aperture 31 defined by the front wall or bar 33 of housing 30.

FIG. 3 illustrates the back surface of plate 16 extending beyond housing 30. In the alternative to attaching to the front wall or bar 33, a bolt 23 of a length sufficient to pass through housing 30 may be used to engage an similar aperture 33 defined by the back wall of housing 30, and is secured thereto by nut 35, as shown in FIG. 3.

With the device 10 so installed, when approaching a locked door in darkness, a homeowner can easily locate the keyhole illuminating device of the present invention, as the constantly-lit rocker switch 26 provides continuous illumination and high visibility, without a significant expenditure of energy. Upon finding illuminated rocker switch 26, a homeowner can actuate it to provide the additional illumination provided by incandescent lamp 20, with which to better see the keyhole and door. A homeowner can switch off incandescent lamp 20 after unlocking the door and entering the building. The quick and inexpensive installation of the present invention also makes it favorable for use in other applications, such as a light source for darker areas of a home or building or motor vehicles.

It is to be understood that the present invention is not limited to the sole embodiment described above, but encompasses any and all embodiments within the scope of the following claims.

I claim:

1. A keyhole illumination device for use with an existing low-voltage power supply comprising:

a plate defining a first window for passing light and a second window;

a housing, having a back wall and a plurality of side walls, dimensioned and configured to engage said plate so as to form an enclosure with said plate, said enclosure having an exterior and an interior;

a plurality of circuit terminals disposed on said exterior of said housing, said plurality of circuit terminals for electrically connecting wiring to the existing low-voltage power supply;

a first light-emitting means having a low-voltage lamp operably disposed within said housing proximate to said first window;

a back-lit toggle switch for controlling illumination of said first light emitting means, said toggle switch closely passing through said second window and including a second light emitting means for continually illuminating said toggle switch from within; and, circuiting means for operably and electrically connecting said circuit terminals to said toggle switch and said first light emitting means and said second light emitting means.

2. The keyhole illumination device according to claim 1, further comprising fastening means for securing said plate to a door jamb.

3. The keyhole illumination device according to claim 2, wherein said fastening means include a plurality of apertures in said plate and a plurality of fasteners dimensioned to pass through each of said plurality of apertures.

4. The keyhole illumination device according to claim 1, wherein said first window is an opening in said plate and further comprising a translucent screen spanning said first window.

5. The keyhole illumination device according to claim 1, said circuiting means comprise conducting wires, said conducting wires connecting said circuit terminals to a low-voltage power supply.

6. The keyhole illumination device according to claim 1, further including supporting means for supporting said low-voltage lamp comprising a support member and a bayonet lamp holder, said bayonet lamp holder engaging said lamp and integrally connecting to said support member, wherein said support member engages the inside back surface of said housing.

7. The keyhole illumination device according to claim 1, said second light emitting means including a second lamp operably disposed within said toggle switch and continually illuminated by the existing low-voltage power supply.

8. The keyhole illumination device according to claim 1, wherein said toggle switch is a rocker switch.

9. A two-stage electrical illumination device for installation on a flat surface comprising;

a pair of interactive lamp assemblies, each said lamp assemblies comprising a light bulb and operational components;

electrical circuit elements operably interconnecting said lamp assemblies with a low-voltage power supply and said circuit elements including a switch assembly, said switch assembly having interior components and an exterior rocker button for manually opening and closing said switch to illuminate said light bulb of the first of said lamp assemblies, and said light bulb of the second of said lamp assemblies being continuously illuminated; a housing defining a chamber having a top, a bottom, sides and base, and. a face plate removably engaging said sides, top and bottom of said chamber, said face plate including a plurality of windows therein, said face plate and said chamber defining an enclosure containing each said pair of interactive lamp assemblies and said electrical circuit elements.

* * * * *